US009687965B2

(12) United States Patent
DeBaker et al.

(10) Patent No.: US 9,687,965 B2
(45) **Date of Patent: *Jun. 27, 2017**

(54) PLIERS

(71) Applicant: Milwaukee Electric Tool Corporation, Brookfield, WI (US)

(72) Inventors: Joseph M. DeBaker, Milwaukee, WI (US); Scott R. Fischer, Menomonee Falls, WI (US); Daniel H. Schneider, Franklin, WI (US); Todd W. Johnson, Wauwatosa, WI (US); Abhijeet A. Khangar, Waukesha, WI (US)

(73) Assignee: MILWAUKEE ELECTRIC TOOL CORPORATION, Brookfield, WI (US)

( * ) Notice: Subject to any disclaimer, the term of this patent is extended or adjusted under 35 U.S.C. 154(b) by 568 days.

This patent is subject to a terminal disclaimer.

(21) Appl. No.: 14/063,015

(22) Filed: Oct. 25, 2013

(65) Prior Publication Data

US 2014/0047956 A1 Feb. 20, 2014

Related U.S. Application Data

(63) Continuation of application No. 13/286,872, filed on Nov. 1, 2011, now Pat. No. 8,661,948.
(Continued)

(51) Int. Cl.
*B25B 7/00* (2006.01)
*B21K 5/00* (2006.01)
(Continued)

(52) U.S. Cl.
CPC ..... *B25B 7/00* (2013.01); *B21K 5/00* (2013.01); *B25B 7/10* (2013.01); *B25B 7/22* (2013.01); *B25G 1/105* (2013.01)

(58) Field of Classification Search
CPC .... B25B 7/10; B25B 7/00; B25B 7/22; B21K 5/00; B25G 1/105
See application file for complete search history.

(56) References Cited

U.S. PATENT DOCUMENTS 236,617 A 1/1881 Paul
334,862 A 1/1886 Harmon
(Continued)

FOREIGN PATENT DOCUMENTS

EP 0070268 1/1983
GB 181250 6/1922
(Continued)

OTHER PUBLICATIONS

European Search Report for Application No. 11838694.5 dated Dec. 23, 2015 (12 pages).
(Continued)

*Primary Examiner* — Robert Scruggs
(74) *Attorney, Agent, or Firm* — Michael Best & Friedrich LLP

(57) ABSTRACT

A pliers includes a first member having a first head and a first handle. The first handle has an enlarged end portion and a grip area adjacent the enlarged end portion. At least a portion of the grip area has a smaller cross-sectional area than the enlarged end portion to define a rear lip located at an interface between the grip area and the enlarged end portion. The pliers also includes a first grip having a first open end and a second open end. The first grip is positioned on the grip area of the first handle. The first handle extends through the first open end and the second open end such that the rear lip of the first handle retains the second grip on the grip area of the first handle.

15 Claims, 12 Drawing Sheets

Related U.S. Application Data

(60) Provisional application No. 61/408,760, filed on Nov. 1, 2010, provisional application No. 61/529,324, filed on Aug. 31, 2011.

(51) Int. Cl.

| | |
|---|---|
| ***B25B 7/10*** | (2006.01) |
| ***B25B 7/22*** | (2006.01) |
| ***B25G 1/10*** | (2006.01) |

(56) References Cited

U.S. PATENT DOCUMENTS

| | | | | |
|---|---|---|---|---|
| 754,740 | A | 3/1904 | Bordewisch et al. | |
| 1,024,120 | A | 4/1912 | Crossley | |
| 1,169,600 | A | 1/1916 | Bastian | |
| 1,169,601 | A | 1/1916 | Bastian | |
| 1,188,380 | A | 6/1916 | Arthur | |
| 1,344,629 | A | 6/1920 | Fowler | |
| 1,522,695 | A | 1/1925 | Noreen | |
| 1,730,722 | A | 10/1929 | Campbell | |
| 1,902,913 | A | 3/1933 | Sievern | |
| 2,531,522 | A | 11/1950 | Malouf | |
| 2,572,237 | A | 10/1951 | Andrews | |
| 2,762,380 | A | 9/1956 | Strickland | |
| 2,981,133 | A | 4/1961 | Campman et al. | |
| 3,072,955 | A | 1/1963 | Mitchell | |
| 3,760,473 | A | 9/1973 | Studdard | |
| 3,921,237 | A | 11/1975 | Steiner | |
| 3,947,904 | A | 4/1976 | Hayes | |
| 3,981,043 | A | 9/1976 | Curry | |
| 4,069,551 | A | 1/1978 | Van Dyke et al. | |
| 4,104,752 | A | 8/1978 | Amrein et al. | |
| 4,206,663 | A | 6/1980 | Pace | |
| 4,306,336 | A | 12/1981 | Kovar | |
| 4,539,873 | A | 9/1985 | Freed | |
| 4,581,960 | A | 4/1986 | Putsch et al. | |
| 4,811,637 | A | 3/1989 | McCleary | |
| D302,780 | S | 8/1989 | Himbert et al. | |
| 4,890,355 | A | 1/1990 | Schulten | |
| 4,893,530 | A | 1/1990 | Warheit | |
| 4,934,222 | A | 6/1990 | Rittmann et al. | |
| 4,953,248 | A | 9/1990 | Trombetta | |
| D312,031 | S | 11/1990 | McCleary | |
| 5,014,379 | A | 5/1991 | Hull et al. | |
| 5,020,399 | A | 6/1991 | Annis et al. | |
| D327,623 | S | 7/1992 | Boche | |
| 5,140,734 | A | 8/1992 | Taggart | |
| 5,291,810 | A | 3/1994 | Lins | |
| 5,348,360 | A | 9/1994 | Mencarelli et al. | |
| D362,181 | S | 9/1995 | Meyers et al. | |
| 5,497,522 | A | 3/1996 | Chen | |
| 5,575,029 | A | 11/1996 | Simpson | |
| 5,664,520 | A | 9/1997 | Latimer, III | |
| 5,797,165 | A | 8/1998 | Armbrust | |
| 5,860,190 | A | 1/1999 | Cano | |
| 6,092,442 | A | 7/2000 | Macor | |
| 6,202,517 | B1 | 3/2001 | Dolan | |
| 6,237,192 | B1 | 5/2001 | Garrison et al. | |
| 6,270,134 | B1 * | 8/2001 | Lin | B25B 7/00 16/422 |
| 6,513,198 | B2 | 2/2003 | Lu | |
| 6,725,486 | B2 | 4/2004 | Oka | |
| 6,769,181 | B1 | 8/2004 | Scheuerman et al. | |
| 6,776,073 | B1 * | 8/2004 | Brady | B25B 7/00 81/416 |
| 7,040,201 | B2 | 5/2006 | Engvall et al. | |
| 7,111,376 | B2 * | 9/2006 | Lombardi | B25B 7/02 29/248 |
| 7,162,758 | B2 | 1/2007 | Skinner | |
| D566,546 | S | 4/2008 | Williamson | |
| 7,673,770 | B2 | 3/2010 | Summerfield | |
| 7,676,873 | B1 | 3/2010 | Simms | |
| 7,703,748 | B2 | 4/2010 | Foley | |
| 7,736,284 | B1 | 6/2010 | Andrews | |
| D624,411 | S | 9/2010 | Puerta | |
| 8,061,239 | B2 | 11/2011 | Farrell | |
| 2004/0016083 | A1 | 1/2004 | Cornett | |
| 2004/0163495 | A1 | 8/2004 | Konen | |
| 2006/0163894 | A1 | 7/2006 | Mishek et al. | |
| 2007/0126193 | A1 | 6/2007 | Hess | |
| 2007/0221016 | A1 | 9/2007 | Herbst et al. | |
| 2008/0022815 | A1 | 1/2008 | Farrell | |
| 2012/0111156 | A1 | 5/2012 | DeBaker et al. | |

FOREIGN PATENT DOCUMENTS

| | | |
|---|---|---|
| GB | 597160 | 1/1948 |
| JP | 02007964 | 1/1990 |
| WO | 2012061419 | 5/2012 |

OTHER PUBLICATIONS

European Supplementary Search Report for Application No. 11838694.5 dated Feb. 11, 2015 (5 pages).

International Search Report for Application No. PCT/US2011/058827 dated Aug. 29, 2012 (8 pages).

International Preliminary Report on Patentability dated May 16, 2013 (6 pages).

* cited by examiner

PLIERS

CROSS-REFERENCE TO RELATED APPLICATIONS

This application is a continuation of co-pending U.S. patent application Ser. No. 13/286,872, filed Nov. 1, 2011, which claims priority to U.S. Provisional Patent Application No. 61/408,760, filed Nov. 1, 2010 and to U.S. Provisional Patent Application No. 61/529,324, filed Aug. 31, 2011; the entire contents of all of which are incorporated by reference herein.

BACKGROUND

The present invention relates to hand tools and, more particularly, to pliers.

A pliers often includes two members that are pivotally connected at a pivot point. A rear end portion of the pliers typically forms a handle of the pliers and a front end portion forms a head of the pliers. The handle is used to open or close jaws formed at the head that pivot about the pivot point, and the handles can be rotated to rotate the head. Therefore, the jaws can be used to grip a fastener, wire, or any suitable material, and the pliers is rotated via the handle to rotate the fastener, wire, or material.

SUMMARY

In one embodiment, the invention provides A pliers includes a first member having a first head and a first handle. The first handle has an enlarged end portion and a grip area adjacent the enlarged end portion. At least a portion of the grip area has a smaller cross-sectional area than the enlarged end portion to define a rear lip located at an interface between the grip area and the enlarged end portion. The pliers also includes a first grip having a first open end and a second open end. The first grip is positioned on the grip area of the first handle. The first handle extends through the first open end and the second open end such that the rear lip of the first handle retains the second grip on the grip area of the first handle. The pliers further includes a second member pivotally coupled to the first member. The second member includes a second head and a second handle. The second handle has an enlarged end portion and a grip area adjacent the enlarged end portion. At least a portion of the grip area has a smaller cross-sectional area than the enlarged end portion to define a rear lip located at an interface between the grip area and the enlarged end portion. The pliers further includes a second grip including a first open end and a second open end. The second grip is positioned on the grip area of the second handle. The second handle extends through the first and second open ends of the second grip such that the rear lip of the second handle retains the second grip on the grip area of the second handle.

In another embodiment, the invention provides a method of manufacturing a pliers. The method includes forming a first member having a first head and a first handle and forming a second member having a second head and a second handle. The first handle and the second handle each have a recessed grip area bounded by a forward lip and a rear lip. The method further includes forming a first grip having a first open end and a second open end, and forming a second grip having a first open end and a second open end. The method further includes positioning the first grip on the recessed grip area of the first handle by sliding an end portion of the first handle that is opposite the first head through the first and second open ends of the first grip such that the end portion of the first handle extends past the second open end of the first grip to expose the end portion of the first handle. The method further includes positioning the second grip on the recessed grip area of the second handle by sliding an end portion of the second handle that is opposite the second head through the first and second open ends of the second grip such that the end portion of the second handle extends past the second open end of the second grip to expose the end portion of the second handle.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Figure 1:
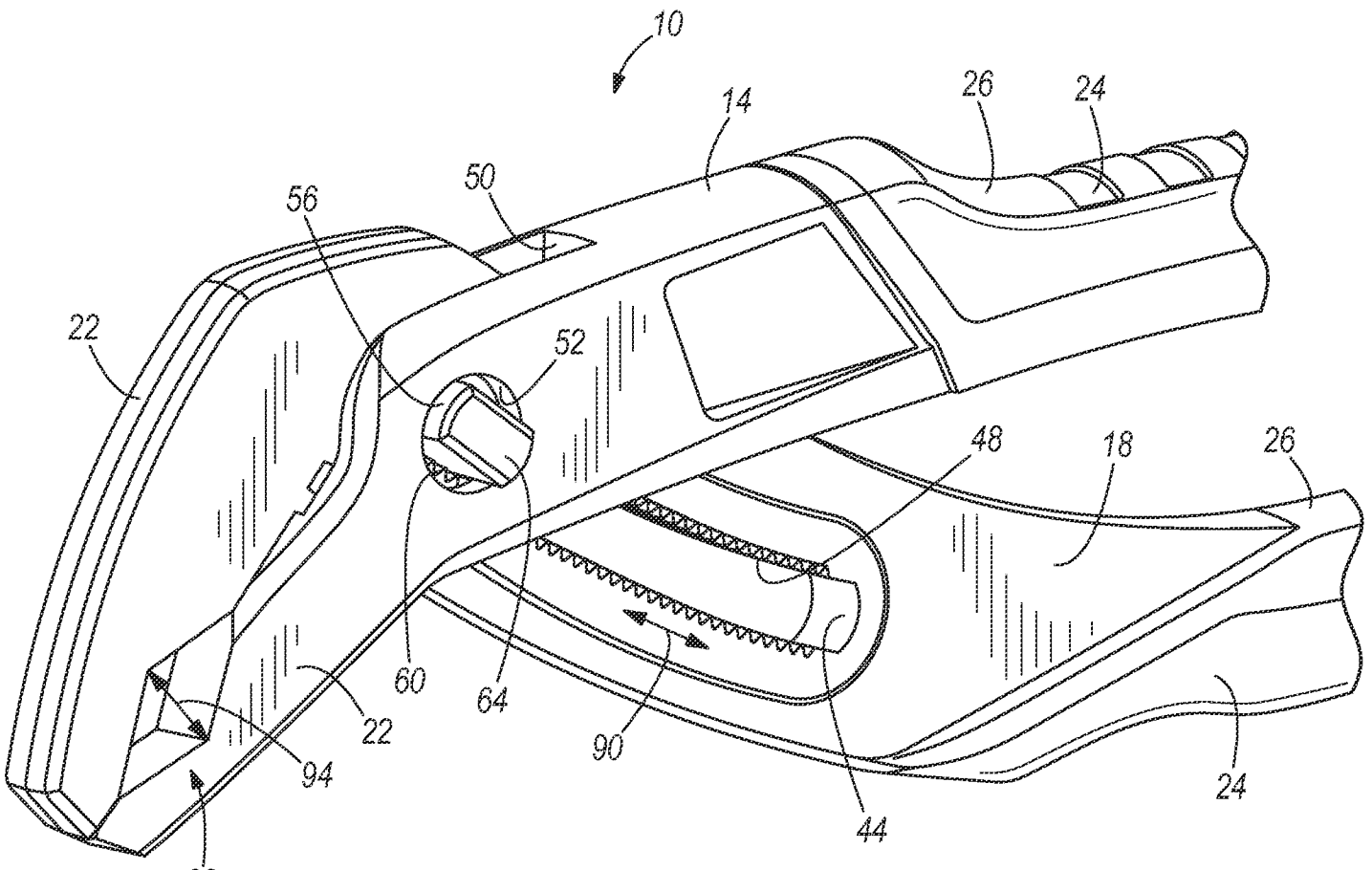
FIG. 1 is a first side view of a pliers according to one embodiment of the invention.

FIG. 1 illustrates a pliers 10, which, in the illustrated embodiment, is an adjustable pliers. The pliers 10 includes a first member 14 and a second member 18. The second member 18 is pivotally connected to the first member 14. The members 14, 18 both include a head portion 22 and a handle portion 24 that are integrally formed as a single component. The handle portions 24 are covered with a grip 26, which is a rubber over mold in the illustrated embodiment. In the other embodiments, the handle portions 24 may be covered with injection molded grips that are created independently from the members 14, 18 and slipped onto the members 14, 18 or the members 14, 18 may be covered with insert molded grips that are molded directly onto the members 14, 18. Together the head portions 22 form jaws 28 of the pliers 10. The jaws 28 are used to grip pipes, electrical conduits, nuts, other types of fasteners, and the like.

The second member 18 of the pliers 10 includes an elongated aperture 44 that extends through the head portion 22. Teeth 48 are located within the elongated aperture 44 to further define the aperture 44. The first member 14 includes a first aperture 50 and the second member 18 extends through the first aperture 50. The first aperture 50 is sized so that the second member 18 can pivot with respect to the first member 14. The first member 14 further includes a second aperture 52 that extends through the first member 14 generally transverse to the first aperture 50 (FIG. 3).

Figure 3:
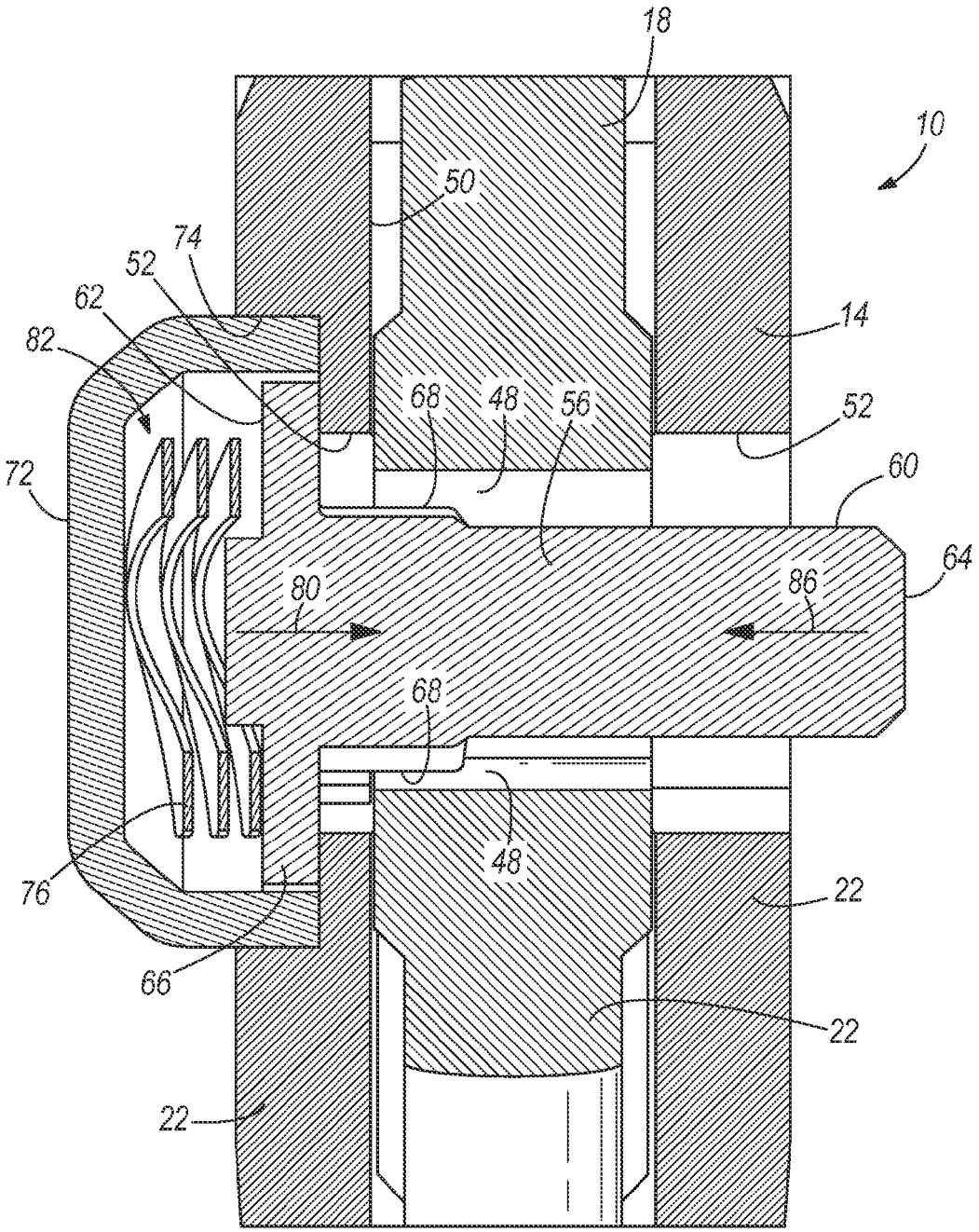
FIG. 3 is a cross-sectional view of the pliers of FIG. 1 taken along line 3-3 of FIG. 2.

Referring to FIG. 3, a pivot pin 56 extends through the first aperture 50 and the second aperture 52 to pivotally couple the first member 14 and the second member 18. The pivot pin 56 includes a first end portion 60 and a second end portion 62. The first end portion 60 includes an end surface 64 and the second end portion 62 includes a flange 66 and teeth 68.

The pliers 10 further includes a cap 72. The cap 72 is press fit into a recess 74 that is formed in the head portion 22 of the first member 14. In other embodiments, the cap 72 may be coupled to the recess 74 using other suitable means. A biasing member 76 is located between the cap 72 and the flange 66 of the pivot pin 56 to bias the pivot pin 56 in the direction of arrow 80 (FIG. 3). In the illustrated embodiment, the biasing member 76 includes three wave springs, but in other embodiments, the biasing member can include fewer or more wave springs, and in yet other embodiments, other types of biasing members can be used. The flange 66 and the cap 72 inhibit dirt, debris, and the like from entering a cavity 82 between the flange 66 and the cap 72 where the wave springs 76 are located.

In operation, a user presses on the end surface 64 of the pivot pin 56 in the direction of arrow 86 against the bias of the wave springs 76. The user presses on the end surface 64 to move the pivot pin 56 in the direction of arrow 86 to move the teeth 68 of the pivot pin 56 out of engagement with the teeth 48 in the aperture 44 of the second member 18. Then, the user slides the pivot pin 56 (i.e., moves the first member 14 with respect to the second member 18 through the aperture 50) along the aperture 44 in the directions of arrows 90 (FIG. 1) to adjust an opening width 94 of the jaws 28. The opening width 94 of the jaws 28 is adjusted in order to grip objects having different sizes. When the user has the jaws 28 adjusted to the desired width, the user releases the end surface 64 of the pivot pin 56 and the wave springs 76 move the pivot pin 56 back to the position illustrated in FIG. 3 so that the teeth 68 of the pivot pin 56 engage the teeth 48 of the second member 18. With the pivot pin 56 in the position illustrated in FIG. 3, the user is able to pivot the members 14, 18 with respect to each other to grasp an object with the jaws 28. Further, the pivot pin 56 does not slide within the aperture 44 in the directions of arrows 90 to keep the opening width 94 fixed in a desired distance.

Figure 2:
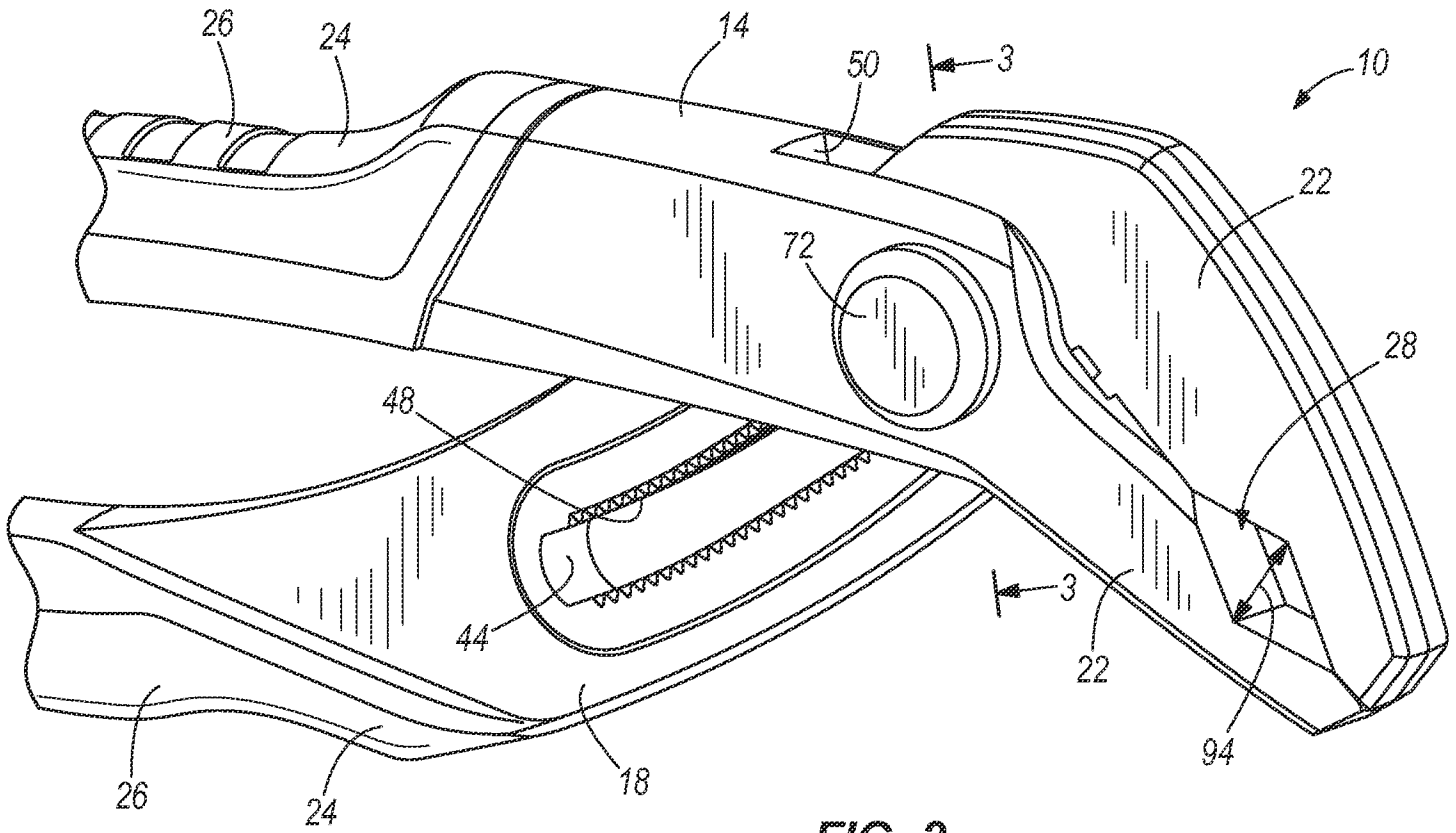
FIG. 2 is a second side view of the pliers of FIG. 1.
Figure 4:
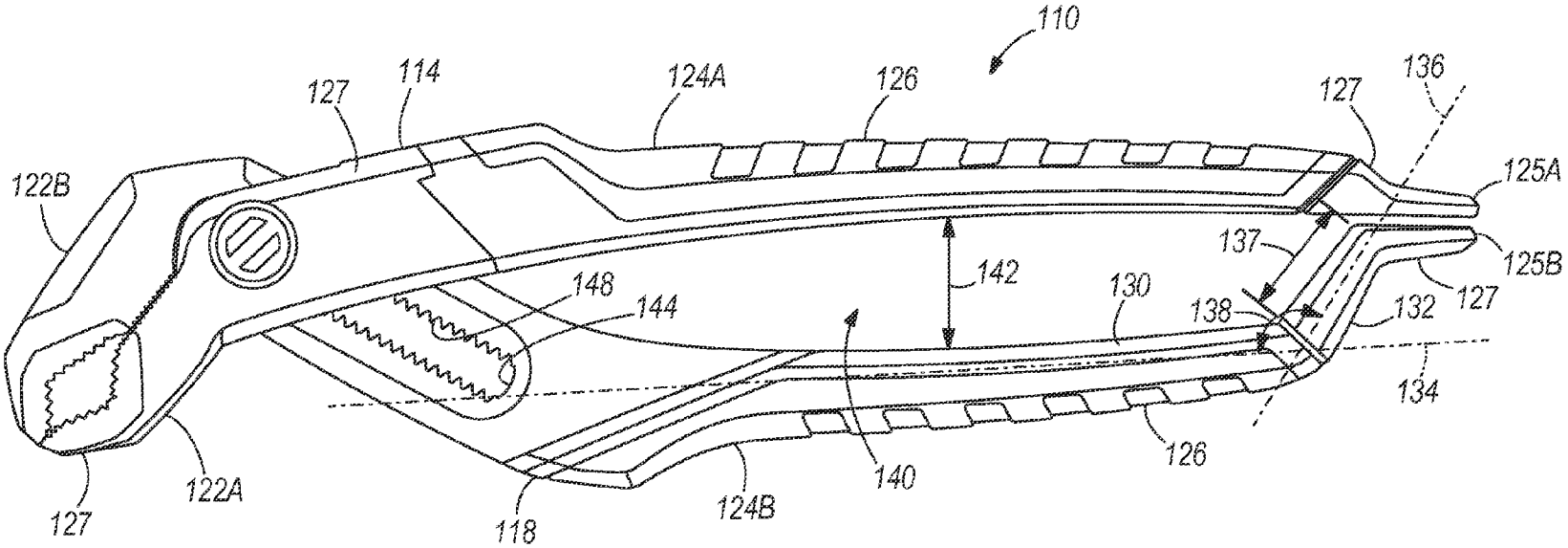
FIG. 4 is a side view of a pliers according to another embodiment of the invention.

FIG. 4 illustrates a pliers 110 according to another embodiment. The pliers 110 includes features similar to pliers 10 of FIGS. 1-3. Accordingly, only differences between the pliers 10 and 110 will be discussed in detail below and like components have been given like reference numbers plus 100.

Referring to FIG. 4, the pliers 110 includes a first member 114 and a second member 118 that is pivotally coupled to the first member 114 as discussed above with regard to the pliers 10 of FIGS. 1-3. The first member 114 includes a head 122A and a handle 124A, and the second member 118 includes a head 122B and a handle 124B. The handles 124A and 124B both include an end portion 125A and 125B, respectively, opposite the heads 122A and 122B, respectively. The end portions 125A and 125B do not include a grip or rubber over mold 126 such that base metal 127 used to form the members 114 and 118 is exposed, a purpose of which will be discussed in more detail below.

The handle 124B further includes a first handle portion 130 and a second handle portion 132 that extends between the first handle portion 130 and the end portion 125B. The first handle portion 130 includes a longitudinal axis 134 and is covered with and surrounded by the rubber over mold grip 126. The second handle portion 132 includes a longitudinal axis 136 and a length 137 measured along the axis 136. The second handle portion 132 does not include the over mold 126 such that the base metal 127 used to form the members 118 is exposed. The second handle portion 132 is bent or at an angle with respect to the first handle portion 130 such that an angle 138 is defined between the longitudinal axes 134, 136. In the illustrated embodiment, the angle 138 is approximately 125 degrees. In other embodiments, the angle 138 can be greater than or less than 125 degrees.

The angle 138 between the first handle portion 130 and the second handle portion 132 provides a relatively large opening or space 140 between the handles 124A, 124B when the members 114, 118 are pivoted to close the heads 122A, 122B (as shown in FIG. 4). Alternatively stated, the angle 138 and the length 137 of the second handle portion 132 maintain a relatively large distance 142 between the handles 124A, 124B. The relatively large distance 142 and the space 140 reduce the likelihood that the user's hand will be pinched between the handles 124A and 124B during operation of the pliers 110.

Figure 5:
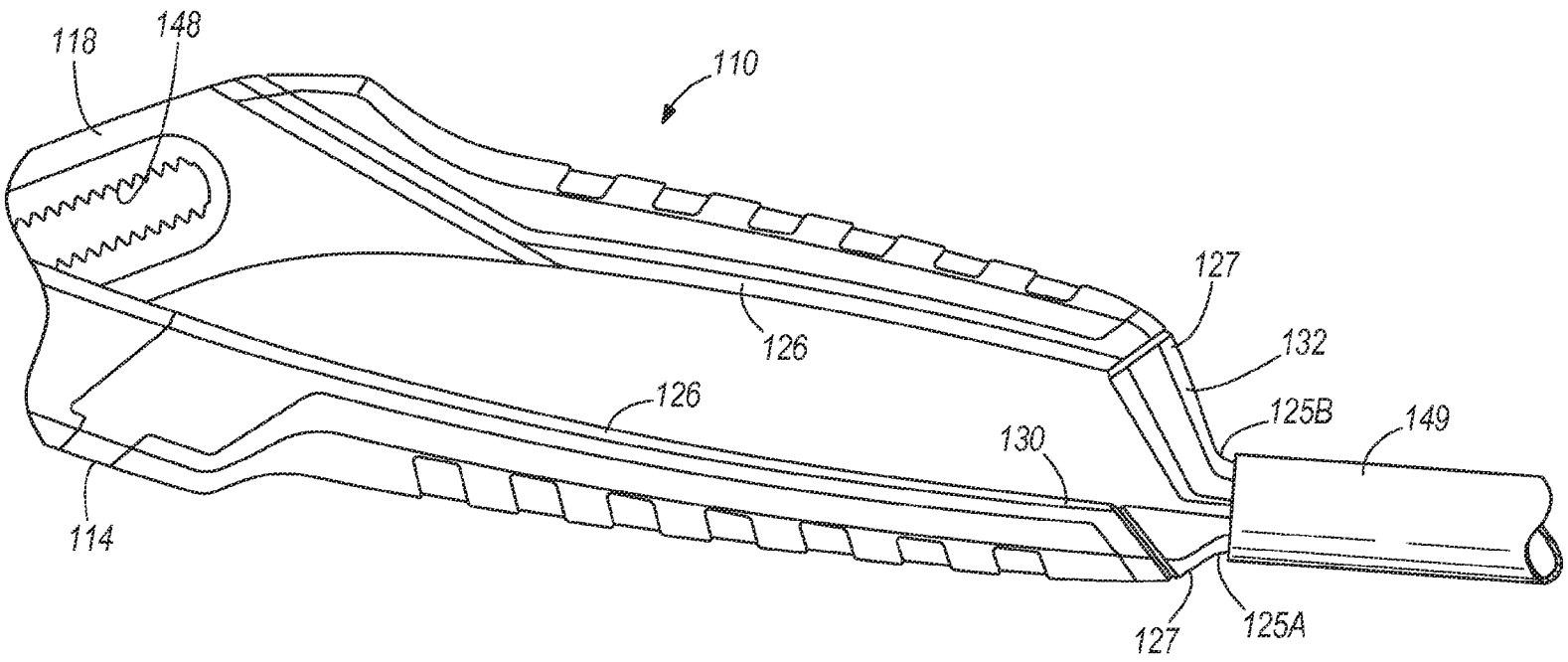
FIGS. 5-7 illustrate the pliers of FIG. 4 during use as a pipe reamer.
Figure 6:
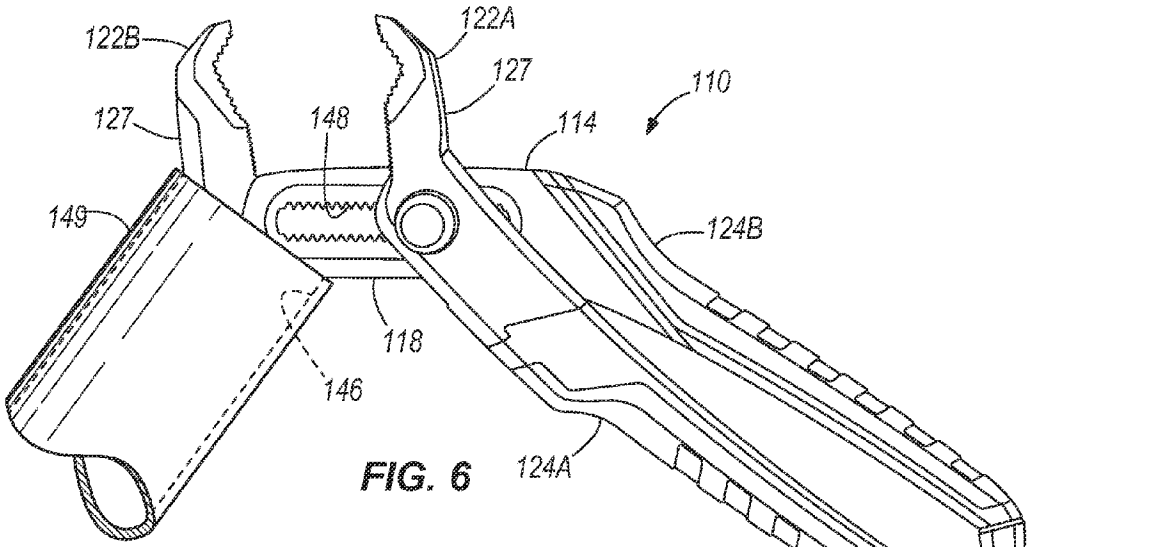
Figure 7:
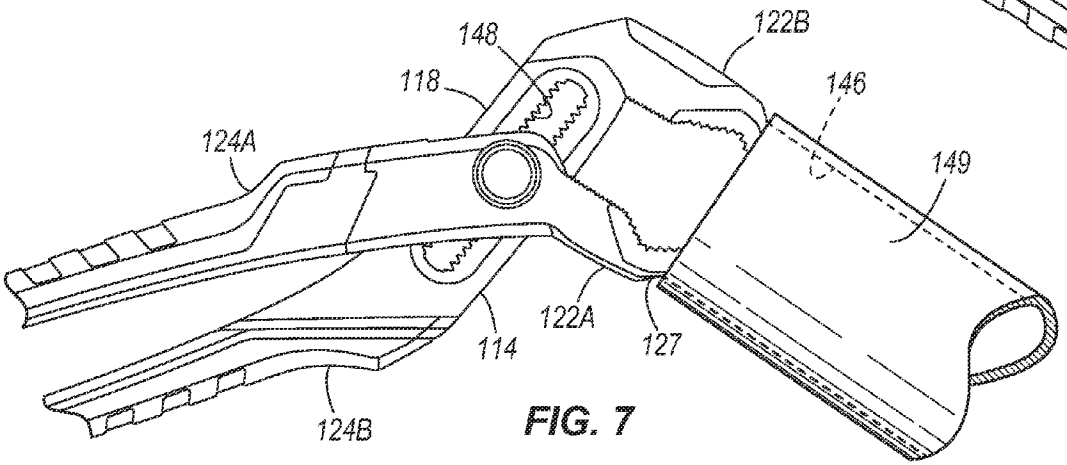

As illustrated in FIGS. 5-7, the pliers 110 can also be used to smooth or ream an inner wall or surface 146 (FIGS. 6 and 7) of a piece of pipe 149, or other conduit. Referring to FIG. 5, as discussed above, the end portions 125A, 125B (FIG. 4) of the handles 124A, 125B, respectively, include exposed base metal 127. The user inserts the end portions 125A, 124B into the pipe 149 until the exposed base metal 127 contacts the pipe 149. The user then rotates the pliers 110 or pipe 149 to remove burrs from the pipe 149 or otherwise smooth the inner surface 146 of the pipe 149. The exposed metal 127 can include ridges, edges, and the like to facilitate removing material from the pipe 149.

Referring to FIGS. 6 and 7, the heads 122A, 122B of the handles 124A, 124B can also be used to ream the pipe 149. The heads 122A, 122B also do not include the rubber over mold 126 and, therefore, the base metal 127 is exposed. As illustrated in FIG. 6, the user can insert the head 122B of the second member 118 into the pipe 149 and rotate the pliers 110 to ream the pipe 149. Referring to FIG. 7, the user can insert both heads 122A, 122B or the jaws 128 into the pipe 149 to ream the pipe 149. In the illustrated embodiment, the end portions 125A, 125B are configured such that the handles 124A, 124B are used to ream a pipe in a first size range, for example ½ inch to 1 inch inner diameter electrical metal tubing ("EMT"), and the heads 122A, 122B are configured to ream pipe of a second size range, for example, greater than 1 inch inner diameter EMT. Thus, in one method of operation, the user determines the size range of the pipe and uses either the handles 124A, 124B or the heads 122A, 122B to ream the pipe depending on the size range (e.g., inner diameter) of the pipe.

Figure 8:
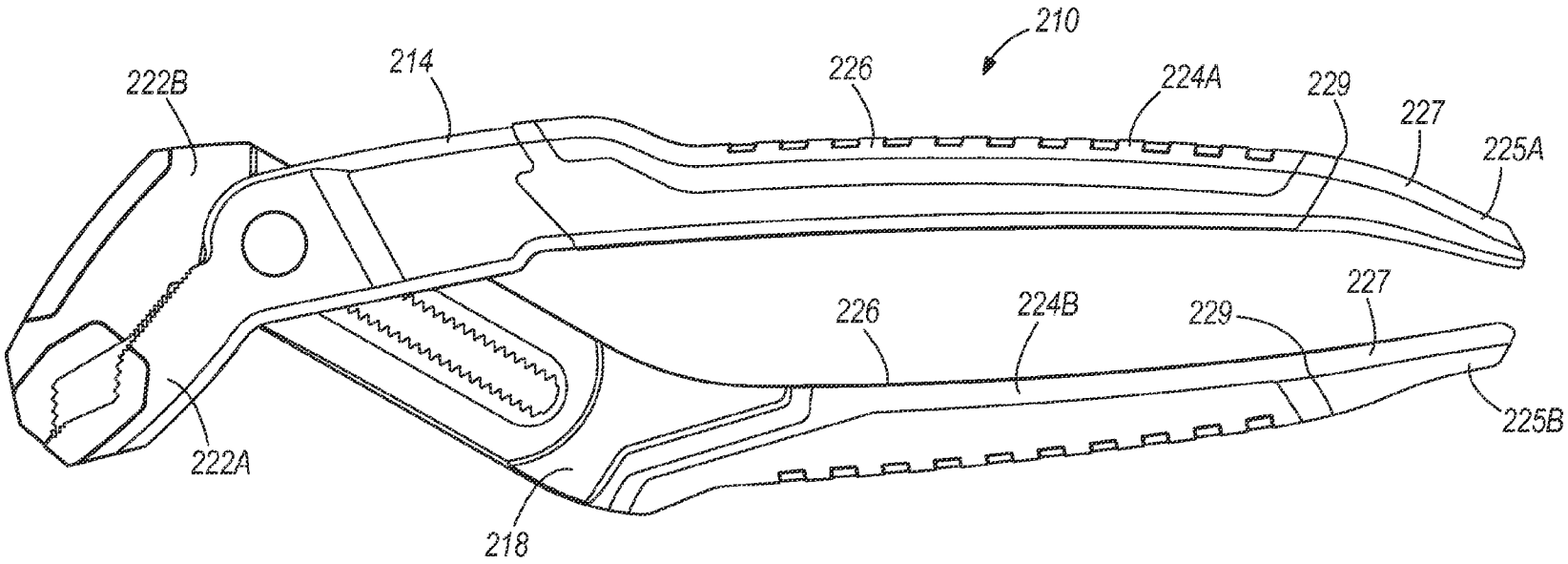
FIG. 8 is a side view of a pliers according to another embodiment of the invention.

FIG. 8 illustrates a pliers 210 according to another embodiment. The pliers 210 includes features similar to the pliers 10 of FIGS. 1-3. Accordingly, only differences between the pliers 10 and 210 will be discussed in detail below and like components have been given like reference numbers plus 200.

Referring to FIG. 8, the pliers 210 includes a first member 214 and a second member 218 that is pivotally coupled to the first member 214 as discussed above with regard to the pliers 10 of FIGS. 1-3. The first member 214 includes a head 222A and a handle 224A, and the second member 218 includes a head 222B and a handle 224B. The handles 224A and 224B both include an end portion 225A and 225B, respectively, opposite the heads 222A and 222B, respectively. The end portions 225A, 225B do not include a rubber over mold 226 such that base metal 227 that is used to form the members 214 and 218 is exposed. In the illustrated embodiment, the over mold 226 is generally flush with the adjacent end portion 225A, 225B such that there is a flush or smooth interface 229 between the over mold 226 and the end portion 225A, 225B. In one embodiment, the rubber over mold 226 is replaced with a rubber slip-on grip that is slid over the base metal 227 of the handles 224A, 224B rather than over molded. In such an embodiment, the slip-on grip still exposes the base metal 227 of the end portions 225A, 225B.

As discussed above with regard to FIGS. 4-7, the end portions 225A, 225B can be used to ream or smooth a cut end of a pipe, and the heads 222A, 222B can also be used to ream a pipe.

FIGS. 9-13 illustrate a pliers 310 according to another embodiment of the invention. The pliers 310 includes features similar to the pliers 10 of FIGS. 1-3, the pliers 110 of FIGS. 4-7, and the pliers 210 of FIG. 8. Accordingly, only differences between the pliers 310 and the pliers 10, 110, 210 will be discussed in detail below, and like components have been given like reference numbers plus 300.

Figure 9:
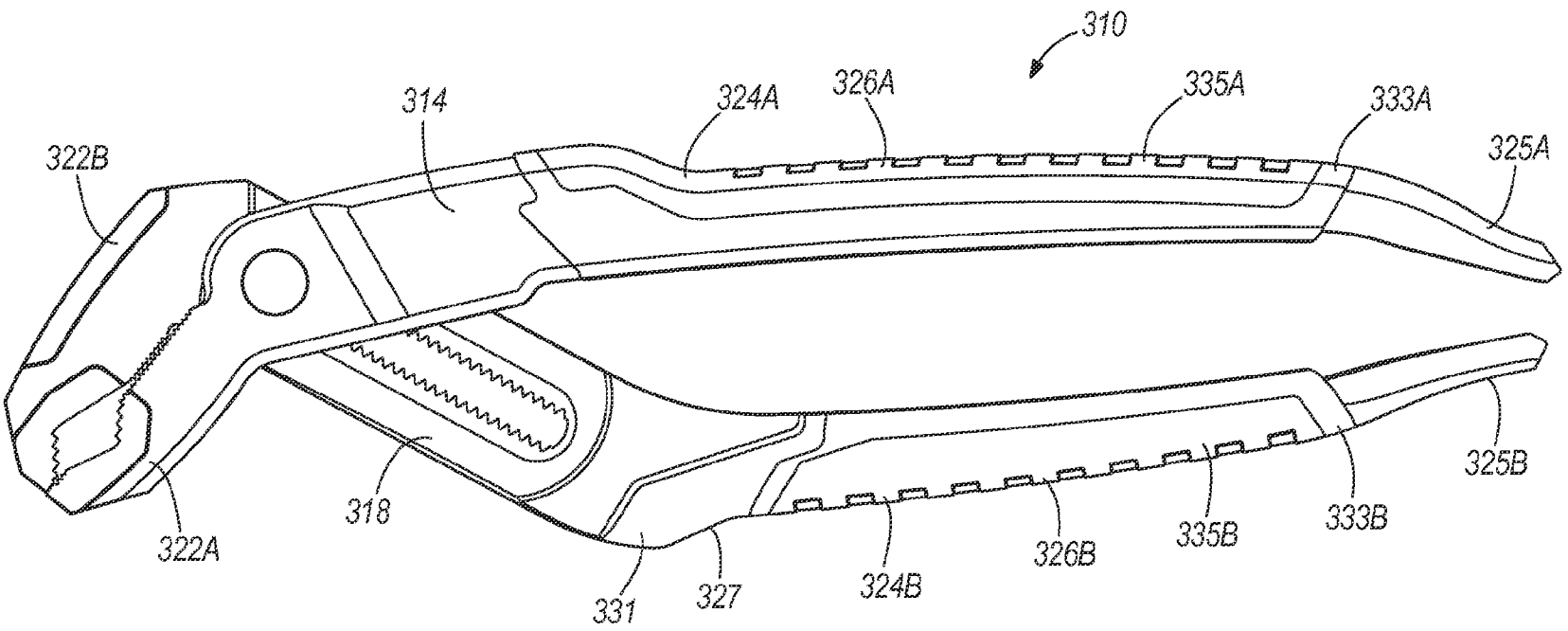
FIG. 9 is a side view of a pliers according to yet another embodiment of the invention.

Referring to FIG. 9, the pliers 310 includes a first member 314 and a second member 318 that is pivotally coupled to the first member 314 as discussed above with regard to the pliers 10 of FIGS. 1-3. The first member 314 includes a head 322A and a handle 324A, and the second member 318 includes a head 322B and a handle 324B. In the illustrated embodiment, the first and second members 314, 318 are formed by forging. In other embodiments, the first and second members 314, 318 may be formed by machining or casting.

Each member also includes a grip 326A, 326B coupled to the corresponding handle 324A, 324B. Unlike the pliers 10, 110, 210 discussed above, the second grip 326B of the illustrated pliers 310 does not extend as far toward the head 322B of the second member 318 such that base metal 327 at a knuckle portion 331 of the second member 318 is exposed. The illustrated grips 326A, 326B are slip-on grips that slide over end portions 325A, 325B of the handles 324A, 324B to fit on the handles 324A, 324B. Providing the grips 326A, 326B as slip-on members, as opposed to insert molding grips directly onto the handles 324A, 324B, reduces the cost of manufacturing the pliers 310, particularly when the members 314, 318 are formed by forging. In some embodiments, such as the illustrated embodiment, each of the grips 326A, 326B includes a first, or base, portion 333A, 333B and a second, or overlay, portion 335A, 335B. The first portions 333A, 333B are composed of a first material having a first hardness (e.g., 80 durometer) and the second portions 335A, 335B are composed of a second material having a second hardness (e.g., 70 durometer), which is less than the first hardness. In other embodiments, the first material can have any suitable hardness and the second material can have any suitable hardness different than the first material. In yet other embodiments, the grips 326A, 326B may be formed from a single material having a uniform hardness.

Figure 10:
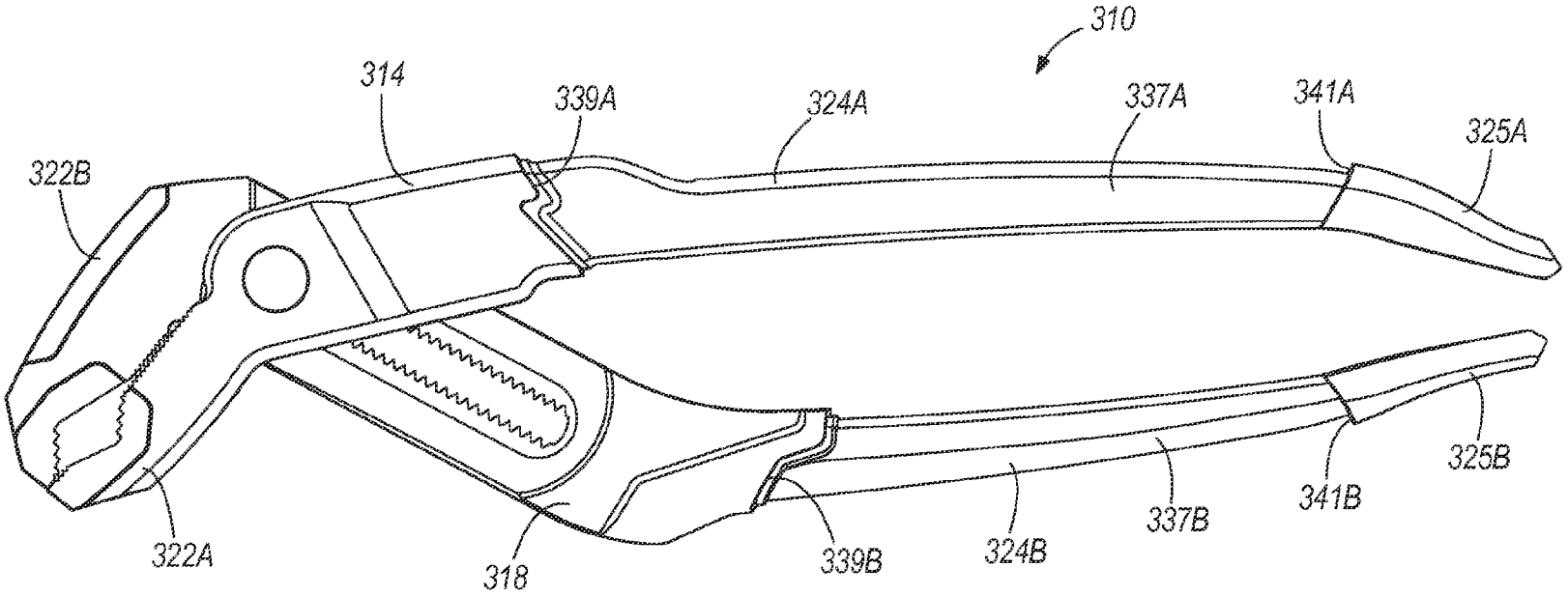
FIG. 10 is a side view of the pliers of FIG. 9 without grips.
Figure 11:
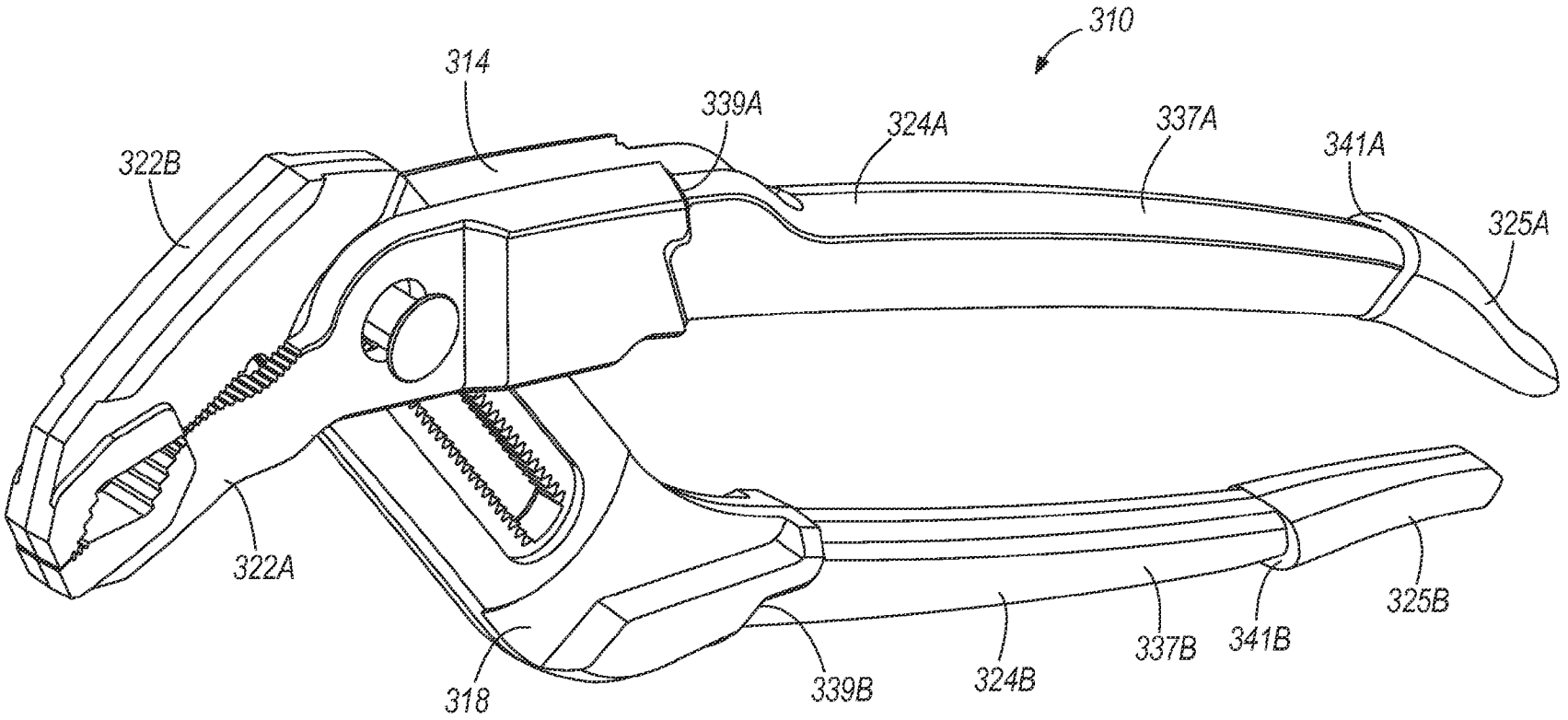
FIG. 11 is a perspective view of the pliers of FIG. 9 without the grips.

As shown in FIGS. 10 and 11, the first handle 324A includes a first grip area 337A and the second handle 324B includes a second grip area 337B. The grip areas 337A, 337B are shaped and sized to receive and support the grips 326A, 326B to couple the grips 326A, 326B to the handles 324A, 324B. In the illustrated embodiment, the grip areas 337A, 337B have a smaller cross-sectional area than the end portions 325A, 325B of the handles 324A, 324B. A forward lip 339A, 339B is formed on each member 314, 318 between the grip area 337A, 337B and the portion of the handle 324A, 324B adjacent the head 322A, 322B, and a rear lip 341A, 341B is formed on each member 314, 318 between the grip area 337A, 337B and the end portion 325A, 325B. The lips 339A, 339B, 341A, 341B define the boundaries of the smaller cross-section grip areas 326A, 326B on the members 314, 318. The grip areas 337A, 337B facilitate positioning the grips 326A, 326B on the handles 324A, 324B and reduce the cross-sectional areas of the handles 324A, 324B so that the grips 326A, 326B are generally flush with the rest of the handles 324A, 324B.

Figure 12:
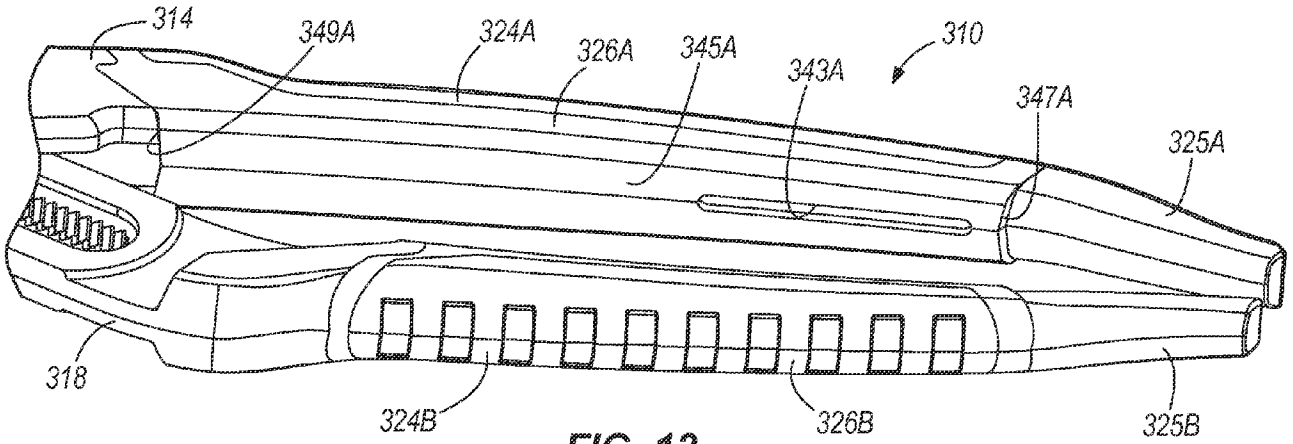
FIG. 12 is a perspective view of a portion of the pliers of FIG. 9.
Figure 13:
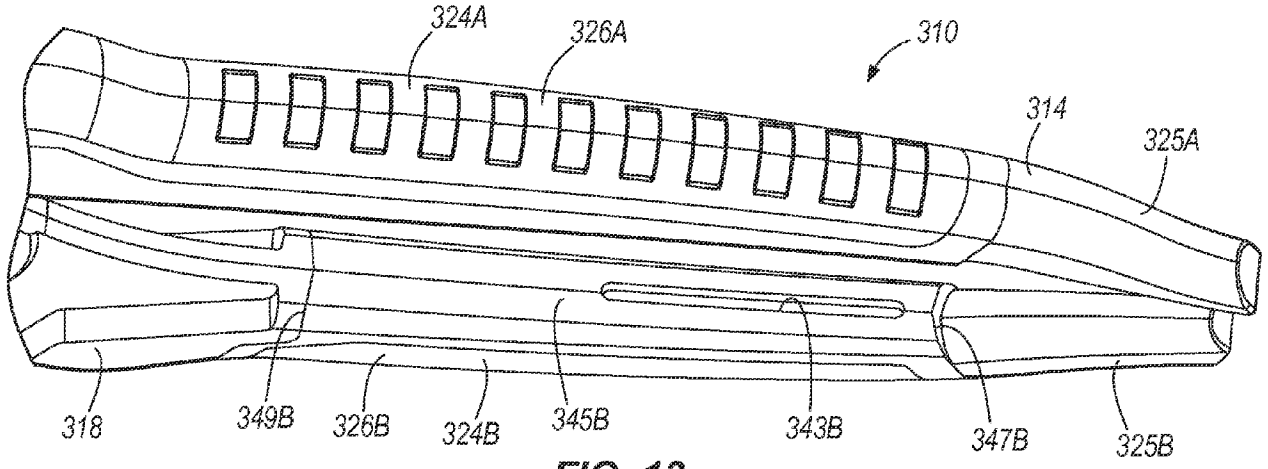
FIG. 13 is another perspective view of the portion of the pliers shown in FIG. 12.

Referring to FIGS. 12 and 13, the first grip 326A includes a first elongated slot 343A and the second grip 326B includes a second elongated slot 343B. In the illustrated embodiment, the slots 343A, 343B extend entirely through the grips 326A, 326B to form openings in the grips 326A, 326B. In other embodiments, the slots 343A, 343B may only extend partway through the grips 326A, 326B such that the slots 343A, 343B define recesses or reliefs where the grips 326A, 326B have less material. The illustrated slots 343A, 343B are formed on inward-facing sides 345A, 345B of the grips 326A, 326B (i.e., the side of each grip 326A, 326B that faces the other grip 326A, 326B) such that the slots 343A, 343B typically do not interfere with a user grasping and squeezing the pliers 310. In the illustrated embodiment, each grip 326A, 326B includes a single elongated slot located adjacent a rear end 347A, 347B of the corresponding grip 326A, 326B (i.e., adjacent the end of the grip 326A, 326B nearest the end portion 325A, 325B of the corresponding handle 324A, 324B). In other embodiments, each grip 326A, 326B may define a series of elongated slots, slits, or other openings formed along the grip 326A, 326B.

In order to assemble the grips 326A, 326B onto the handles 324A, 324B, the grips 326A, 326B are slid over the end portions 325A, 325B of the handles 324A, 324B toward the heads 322A, 322B. As the end portions 325A, 325B pass through the grips 326A, 326B, the grips 326A, 326B are stretched and deflected. The elongated slots 343A, 343B allow the grips 326A, 326B to stretch and deflect to fit over the enlarged end portions 325A, 325B of the handles 324A, 324B. The illustrated grips 326A, 326B generally taper in cross-sectional area from a forward open end 349A, 349B (i.e., the end of the grip 326A, 326B nearest the head 322A, 322B) to the rear open end 347A, 347B such that the forward open ends 349A, 349B are generally large enough to slide over the end portions 325A, 325B of the handles 324A, 324B without slots.

Figure 14:
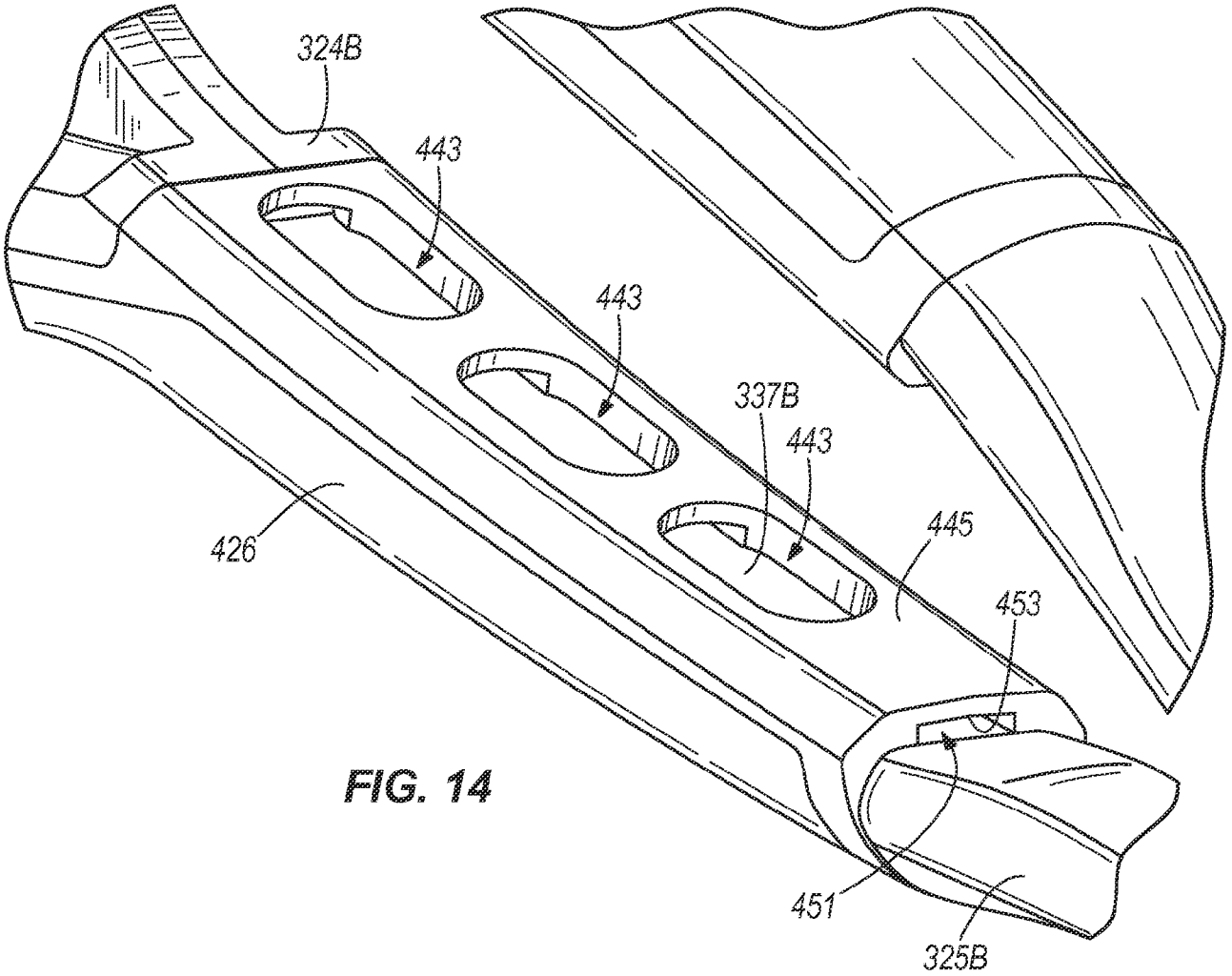
FIG. 14 is a perspective view of a portion of the pliers of FIG. 9 including another embodiment of a grip.

FIG. 14 illustrates another embodiment of a grip 426 for use with the pliers 310. The grip 426 includes features similar to the grips 326A, 326B shown in FIGS. 12-13. Accordingly, only differences between the grip 426 and the grips 326A, 326B will be discussed in detail below, and like components have been given like reference numbers plus 400.

The illustrated grip 426 is an injection molded, slip-on grip that slides over the enlarged end portion 325B of the handle 324B. In the illustrated embodiment, the grip 426 includes three discrete slots 443 and a relief 451 extending the length of the grip 426. In other embodiments, the grip 426 may include fewer or more slots 443. The slots 443 are generally evenly spaced along and formed through an inward-facing side 445 of the grip 426. The relief 451 is formed on an inner surface 453 of the grip 426 that faces the grip area 337B to remove material from the grip 426. In some embodiments, the slots 443 may be omitted such that the grip 426 only includes the relief 451. In other embodiments, the relief 451 may be omitted such that the grip 426 only includes the slots 443. The slots 443 and the relief 451 facilitate stretching the grip 426 to slide the grip 426 over the enlarged end portion 325B and onto the handle 324B.

Although the invention has been described in detail with reference to certain preferred embodiments, variations and modifications exist within the scope and spirit of one or more independent aspects of the invention as described. For example, aspects of the invention may be applied to other types of hand tools with pivotable members, such as pex cutters, snips, riveters, wire strippers, and the like. Various features and advantages of the invention are set forth in the following claims.

The invention claimed is:

1. A pliers comprising:

a first member including a first head and a first handle having a recessed grip area bounded by a forward lip and a rear lip, the forward lip having a cross-sectional area not greater than a cross-sectional area of a portion of the first handle adjacent the forward lip and opposite the grip area;

a first grip positioned on the grip area of the first handle;

a second member pivotally coupled to the first member, the second member including a second head and a second handle having a recessed grip area bounded by a forward lip and a rear lip, the forward lip having a cross-sectional area not greater than a cross-sectional area of a portion of the second handle adjacent the forward lip and opposite the grip area; and a second grip positioned on the grip area of the second handle.

2. The pliers of claim 1, wherein the first handle and the second handle each include an exposed end portion, a cross-sectional area of the end portion continually increasing from a tip of the end portion to the rear lip such that the end portion has a tapered shape.

3. The pliers of claim 2, wherein the first grip is substantially flush with the portion of the first handle adjacent the forward lip and with the end portion of the first handle, and wherein the second grip is substantially flush with the portion of the second handle adjacent the forward lip and with the end portion of the second handle.

4. The pliers of claim 2, wherein the first and second members are made of metal.

5. The pliers of claim 4, wherein the end portions of the first and second handles are configured for reaming conduit.

6. The pliers of claim 4, wherein the first grip and the second grip are made of rubber.

7. The pliers of claim 4, wherein the first grip and the second grip each include a base portion made of a first material and an overlay portion made of a second material different than the first material.

8. The pliers of claim 7, wherein the first material has a first hardness and the second material has a second hardness different than the first hardness.

9. The pliers of claim 8, wherein the second hardness is less than the first hardness.

10. The pliers of claim 9, wherein the first hardness is about 80 durometer and the second hardness is about 70 durometer.

11. The pliers of claim 1, wherein the first grip includes a first open end and a second open end, the first grip being positioned on the grip area of the first handle between the forward lip and the rear lip such that the first handle extends through the first open end and the second open end, and wherein the second grip includes a first open end and a second open end, the second grip being positioned on the grip area of the second handle between the forward lip and the rear lip such that the second handle extends through the first open end and the second open end.

12. The pliers of claim 1, wherein the second member includes an elongated aperture, and wherein the first member is pivotally coupled to the second member by a pin extending through the elongated aperture.

13. The pliers of claim 12, wherein the first head includes a first jaw, wherein the second head includes a second jaw, and wherein the pin is movable along the elongated aperture to adjust a spacing between the first jaw and the second jaw.

14. The pliers of claim 13, further comprising a plurality of teeth disposed along the elongated aperture.

15. The pliers of claim 1, wherein the first and second members are made of metal, wherein the second member includes an elongated aperture, and wherein the first member is pivotally coupled to the second member by a pin extending through the elongated aperture, wherein the first head includes a first jaw, wherein the second head includes a second jaw, and wherein the pin is movable along the elongated aperture to adjust a spacing between the first jaw and the second jaw, wherein the first handle and the second handle each include an exposed end portion, wherein at least one of the first grip and the second grip includes a base portion made of a first material having a first hardness and an overlay portion made of a second material having a second hardness different than the first hardness, wherein the first grip includes a first open end and a second open end, the first grip being positioned on the grip area of the first handle between the forward lip and the rear lip such that the first handle extends through the first open end and the second open end, and wherein the second grip includes a first open end and a second open end, the second grip being positioned on the grip area of the second handle between the forward lip and the rear lip such that the second handle extends through the first open end and the second open end.

* * * * *